US009828697B2

(12) United States Patent
Mueller et al.

(10) Patent No.: US 9,828,697 B2
(45) Date of Patent: Nov. 28, 2017

(54) FLAME-RETARDANT REGENERATED CELLULOSE FILAMENT FIBERS AND PROCESS FOR PRODUCTION THEREOF

(75) Inventors: Bernhard Mueller, Baden (AT); Martin Gebert-Germ, Horn (AT)

(73) Assignee: Glanzstoff Bohemia s.r.o., Lovosice (CZ)

( * ) Notice: Subject to any disclaimer, the term of this patent is extended or adjusted under 35 U.S.C. 154(b) by 974 days.

(21) Appl. No.: 14/116,288

(22) PCT Filed: May 14, 2012

(86) PCT No.: PCT/EP2012/002069

§ 371 (c)(1),
(2), (4) Date: Mar. 6, 2014

(87) PCT Pub. No.: WO2012/152451

PCT Pub. Date: Nov. 15, 2012

(65) Prior Publication Data

US 2014/0210120 A1 Jul. 31, 2014

(30) Foreign Application Priority Data

May 12, 2011 (DE) ..... 10 2011 191 321

(51) Int. Cl.
*D01F 2/08* (2006.01)
*D01F 1/07* (2006.01)
(Continued)

(52) U.S. Cl.
CPC ..... *D01F 2/08* (2013.01); *D01D 5/12* (2013.01); *D01F 1/07* (2013.01); *D01F 2/06* (2013.01)

(58) Field of Classification Search
CPC ..... B29C 47/8895
(Continued)

(56) References Cited

U.S. PATENT DOCUMENTS 2,987,371 A 6/1961 Henry
3,875,141 A * 4/1975 Drisch ..... D01F 2/08 264/188
(Continued)

FOREIGN PATENT DOCUMENTS

AT 193069 B 11/1957
GB 792793 A 4/1958
(Continued)

OTHER PUBLICATIONS

International Preliminary Report on Patentability dated Nov. 21, 2013 for International Application No. PCT/EP2012/002069, 8 pages.
(Continued)

*Primary Examiner* — Christina Johnson
*Assistant Examiner* — Xue Liu
(74) *Attorney, Agent, or Firm* — Schwabe, Williamson & Wyatt, P.C.

(57) ABSTRACT

In a process for producing regenerated cellulose fibers, in which particles of a flame-retardant solid are incorporated into the fiber, the particles are placed into a mold, the dimension of which in a major axis of the particle is greater than in the two orthogonal minor axes of the particle, and the major axes of the particles in the fiber are aligned in a preferential direction parallel to the spinning direction thereof.

13 Claims, 2 Drawing Sheets

(51) Int. Cl.
*D01F 2/06* (2006.01)
*D01D 5/12* (2006.01)

(58) Field of Classification Search
USPC ..... 264/178 R, 181, 187, 188, 196, 197
See application file for complete search history.

(56) References Cited

U.S. PATENT DOCUMENTS

| | | | | |
|---|---|---|---|---|
| 3,997,647 | A * | 12/1976 | Lassen | A61F 13/15203 264/178 F |
| 4,066,730 | A * | 1/1978 | Mimura | C07F 9/4006 106/166.2 |
| 4,405,549 | A * | 9/1983 | Turbak | D01F 2/06 264/188 |
| 2006/0246285 | A1 * | 11/2006 | Schmidtbauer | B01J 20/28004 428/365 |
| 2010/0190402 | A1 | 7/2010 | Tozzi-Spadoni et al. | |
| 2012/0177919 | A1 | 7/2012 | Kroner | |

FOREIGN PATENT DOCUMENTS

| | | | |
|---|---|---|---|
| GB | 861831 | A | 3/1961 |
| GB | 977945 | A | 12/1964 |
| GB | 1414770 | A | 11/1975 |
| GB | 2008126 | A | 5/1979 |
| WO | WO 2011/026159 | A1 | 3/2011 |

OTHER PUBLICATIONS

Choudhary M. S. et al., "Investigation of the action of flame retardants in cellulose. I. Investigation of the flame retardant of action of 2, 2-oxybis (, 5-dimethyl -1,3,2-dioxaphospho rinane-2, 2-disulfide) in cellulose", Journal of Applied Polymer Science, John Wiley & Sons, Inc., US. vol. 30, No. 11, Nov. 1, 1985.

International Search Report dated Jul. 17, 2012 for International Application No. PCT/EP/20121002069, 7 pages.

Gotze, Kurt, "Chemiefasern nach dem Viskoseverfahren," Springer-Verlag, 1967, p. 211.

Hackh, et al., "Hackh's Chemical Dictionary", 1969, McGraw-Hill, p. 141.

"Viskosefasern," Lexikon der Chemie, Spektrum Akademischer Verlag, [online], 1998, [retrieved Aug. 15, 2016] Retrieved from the internet: <URL: http://www.speldrum.de/lexikon/chemie/visosefasern/9799>, 3 pages.

"Substance Name: Morpholine, 4,4'41 ,2-ethanediy1)bis-" ChemIDPlus: A Toxnet Database, [online], 1993, [retrieved Jun. 16, 2016] Retrieved from the internet: <URL: http://www.chem.sis.nlm.nih.gov/chemidplus/rn/1723-94-0>, 3 pages.

"C17H33N3O3 Morpholine, 4,4'(3-morpholinopentamethylene)di-(6CI)" SciFinder, 2016, 1 page.

* cited by examiner

FLAME-RETARDANT REGENERATED CELLULOSE FILAMENT FIBERS AND PROCESS FOR PRODUCTION THEREOF

CROSS REFERENCE TO RELATED APPLICATION

The present application is a 35 U.S.C. §371 national phase entry application of, and claims priority to, International Patent Application No. PCT/EP2012/002069, filed May 14, 2012, which claims priority to German Patent Application No. DE 102011191321.4, filed May 12, 2011, the disclosures of which are hereby incorporated by reference in their entirety for all purposes.

BACKGROUND

The invention relates to a process for producing regenerated cellulose fibers, in which viscose is mixed with a dispersion of particles of a flame-retardant solid in a dispersant at a specific quantitative ratio, and the mixture resulting thereby is wet-spun in accordance with specific spinning parameters, as well as to a regenerated cellulose fiber in particular produced by this process, as well as to additional processes for manufacturing regenerated cellulose fibers, in particular in the form of multifilaments as well as to multi-filament yarns and textile fabrics made from them (in particular according to ISO 11612.)

Processes for producing flame-resistant regenerated cellulose fibers are known from prior art but losses in strength frequently occur in them.

DETAILED DESCRIPTION

Figure 1:
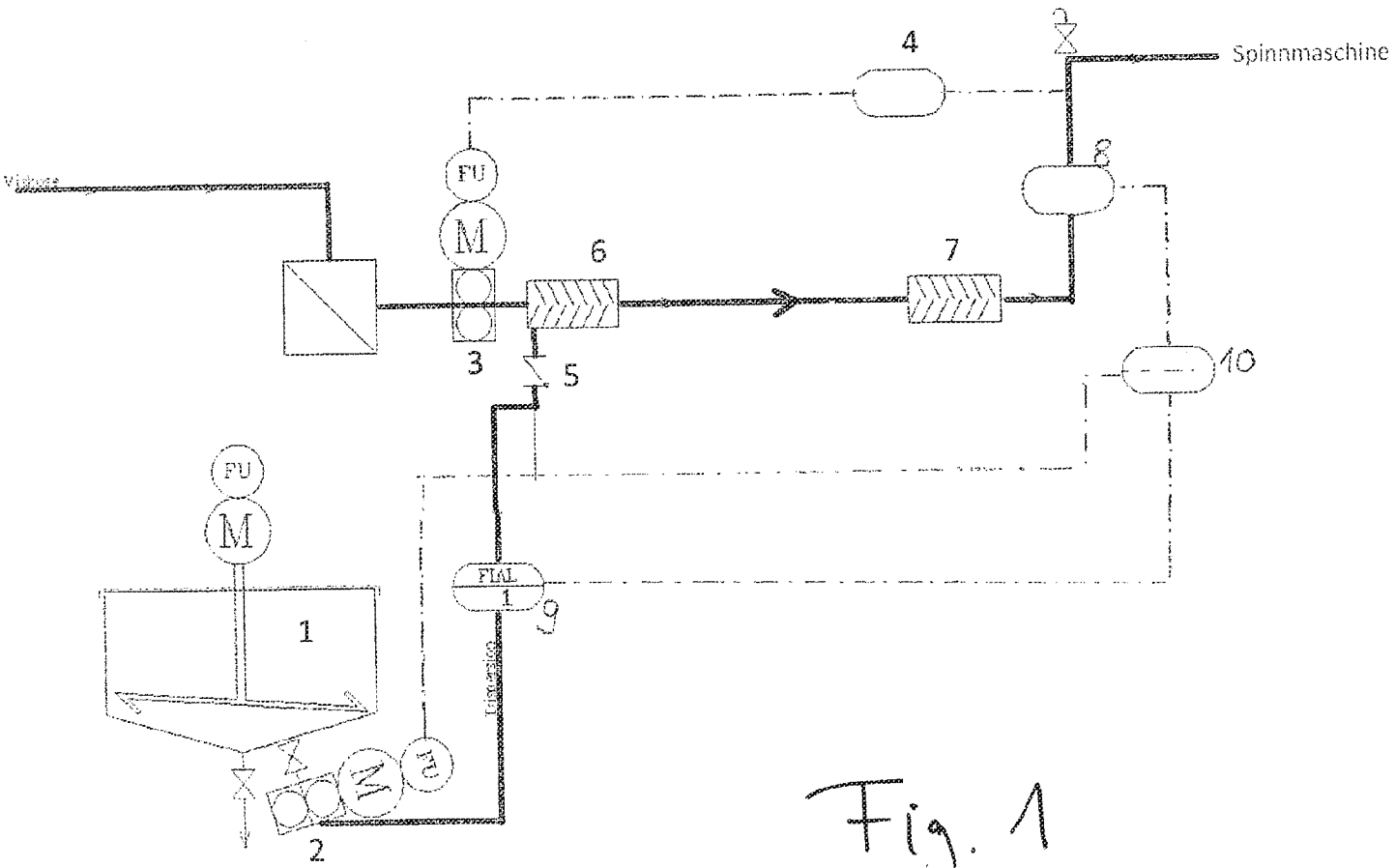
FIG. 1 is a block diagram of an example system to practice the embodiments described herein

The invention is based on the objective of creating a process of the type stated in the preamble and a flame-resistant regenerated cellulose fiber, in particular a continuous fiber, where only slight strength losses occur and where the strength of the fiber satisfies in particular the exacting requirements for protective clothing, in particular according to ISO 11612.

According to the invention, this objective is achieved with respect to the process in that the particles are formed into a shape whose dimension in one major particle axis is greater than in the two minor particle axes that are orthogonal to it and the major particle axes in the fiber are aligned in a preferential direction parallel to their spinning direction.

Hence, in the process according to the invention, the major axes of the particles incorporated in the fiber are aligned in such a way that, in the ideal case, their major axes are aligned parallel to the spinning direction of the filament. In practice, an approximation to this ideal state suffices and consists in that the alignment density function of the incorporated particles gains its maximum in the spinning direction of the filament. Preferably the ratio of the particle diameter in the plane spanned by the two minor particle axes to the length of the particle measured along the major axis is approximately 1:3. Preferably, the shape of the particles is a rotary ellipsoid.

By a suitable selection of the spinning parameters, in particular the draw-off speed, flame-retardant regenerated cellulose fibers with an LOI greater than 26 cN/tex, in particular 27 cN/tex, and strengths greater than 25 cN/tex, preferably greater than 26 cN/tex, more preferred greater than 29 CN/tex and in particular of 30 cN/tex can be produced. The decrease in breaking tenacity in the conditioned state of the flame-retardant regenerated cellulose filament fiber against a comparable regenerated filament fiber which does not contain any flame-retardant particles, is in particular lower than 28%. Preferably a strength decrease of less than 25% and particularly preferred a strength decrease of less than 20% is achievable. Another parameter that must be appropriately selected is the post-stretching of the fiber in a second bath.

A preferred embodiment of the process according to the invention provides for the particle size distribution of the dispersion used as starting material of the process to be adjusted before being introduced into the mixing process in a nozzle-based dispersing apparatus.

For example, batch and formulation dependent, the total solids content of a flame retardant dispersion available under the trade name Viskofil® Exolit 5060 VP VP2988 is between 51 to 56 percent, where, batch-dependent, the proportion of the flame-retardant material varies between 41 to 47 percent, in particular 45 percent, in particular 43 to 47 (45) percent. In the nozzle-based dispersing apparatus, which is preferably an apparatus available under the product name Serendip Dispersion Device, for example Serendip LPN 60 or Serendip 500, agglomerates caused by transport and/or storage of this commercially available dispersion are broken open. As a result, a short exposure to energy action leads to a particle size distribution, the mean particle diameter of which is in a particularly favorable range between 0.7 μm and 0.8 μm and has a very close grain size distribution.

Furthermore, it proves to be advantageous if, to the dispersion used as starting material of the process, at least one additional dispersant is added before being introduced into the mixing process. The dispersant can originate either from the group of anionic, of cationic as well as of non-ionic dispersants.

The addition of the additional dispersants benefits in particular a procedure, in which filtering of the mixture, from which the regenerated cellulose fiber is spun, is only carried out in two coarse filters, in which particles larger than 25 μm are retained. A filter equipment series of one 10 μm fine filter and one 30 μm coarse filter, as proposed in the state of the art according to EP 1 882 760, is not needed for this arrangement. As a result, the process according to the invention is substantially more economical because exclusively the two coarse filter are used that are more advantageous in their acquisition and maintenance.

Particularly preferred is the use of a 1.8 dtex capillary titer and 40 μm to 60 μm spinneret hole diameters. The average diameter of the individual fiber is between 10 μm and 30 μm, preferably 11 μm to 20 μm, a preferred upper limit for the capillary titer being 2.6 dtex. For yarn titers below 330 dtex, the preferred capillary titer is in the range of 2.2 dtex to 2.6 dtex.

Further provided within the scope of the invention is that the viscose is introduced into the mixing process as feed stream of a viscose pump whose delivery rate is regulated as a function of a measurement of the pressure in the delivery stream discharged from the mixing process. This viscose pump may, for instance, be a gear pump.

An additional advantageous enhancement of the process according to the invention consists in that the dispersion is introduced into the mixing process by a metering pump, the delivery rate of which is regulated as a function of a measurement of the mass flow of the dispersion that is introduced into the mixing process. Uniform metering of the dispersion input into the cellulose is of particular significance for the strength of the regenerated fiber. Adhering to an established constant ratio of dispersion to viscose could for example be achieved mechanically in the form of a transmission between the viscose pump and the metering pump. This would, however, only keep the ratio of the volumetric flows constant. In contrast, the mass flow-dependent control of the metering pump allows uniform metering of the dispersion. As the mass flow meter, preferably a Coriolis-Mass Flow Gauge will be used. As metering pump, preferably an eccentric screw pump will be used, because with dispersions having a high solids content, it assures a substantially longer useful life.

Preferably, the α-cellulose content of the cellulose used will be greater than 97.5 percent, in particular 98 percent, with a DP greater than 400, in particular greater than 1500, in order to reach the strengths according to the invention, as well as a viscose DP greater than 400.

Moreover preferably, the cellulose will be a kraft coniferous pulp having an α-cellulose content greater than 97.5%, in particular with monomodal molecular weight distribution.

The viscosity of the viscose is preferably greater than 100 kfs at 20° C., and the incorporated water-insoluble flame-retardant particles will have rotary ellipsoid form, where the longer major axes are aligned in a preferred direction parallel to the direction of elongation of the fiber. This allows achieving particularly high strength.

As flame retardant material, preferably a phosphorus-containing substance, in particular 2,2'-oxybis[5,5-dimethyl-1,3,2-dioxaphosphorinane]2,2' disulphide will be used. The phosphorus content of the finished fiber is preferably in the range of 2.8% to 4.2%, particularly preferred 3% to 4% with reference to the α-cellulose.

Exemplary, the limits of the machine parameters are indicated, within which, for the titer 200f100[corrected: 200f110], spinning that corresponds to the process according to the invention is preferred for the aspect of the invention hitherto described.

| Titer | cN/100 dtex | Spinning Bath °[C] | B-Bath °[C] | Cylinder Heating °[C] | Elongation [%] | Draw-off [m/min] |
|---|---|---|---|---|---|---|
| 100f110 HT-FR | 240-310 | 50-70 | 75-98 | 75-95 | >70 | >60 |

In an additional aspect, the invention generally relates to a process for producing regenerated cellulose fiber, in particular a multifilament fiber, wherein a solid is additionally added to the viscose prior to wet-spinning and wherein, after at least partial coagulation of the filaments in the spin bath, following extrusion of the spin mass, another elongation takes place in the second bath, from which the filaments are drawn off at a final draw-off speed.

It has been found that multifilaments produced according to this process from viscose, with respect to their strengths, either no longer satisfy modern textile requirements or otherwise, if they satisfy the requirements with respect to the attainable strengths, difficulties occur during further processing of the multifilament yarns into textile structures, particularly if it is intended to use the multifilament as warp material.

Particularly due to market scarcity, fiber products presently used for this purpose are in particular based on alternatives, primarily on staple fiber yarns using the Lenzing® FR-fiber. But it is exactly for use as warp material that these staple fiber yarns are only conditionally suitable.

This additional aspect of the invention is, therefore, based on the objective of enhancing a process as mentioned above in such a way that the capacity for further processing of the fiber products produced using it is improved, particularly with respect to use as a warp material, in particular for the production of high-quality textile products for use as protective clothing, for instance.

This objective is achieved by this aspect of the invention by an enhancement of the stated process, which is essentially characterized in that a dimensionless first parameter formed from the quotient of elongation measured in percent and the final draw-off speed measured in meters per minute is less than 2.5, preferably less than 2.0, in particular less than 1.67.

This is so because within the scope of the invention it has been recognized that, on the one hand, due to the addition of solids (such as a flame retardant) and, on the other hand, by elongation in a secondary bath (B-bath) while applying known process parameters, a risk of increased brittleness of the produced fibers exists, which has a direct negative effect on the surface properties of the produced fibers and yarns. By the selection of the first parameter according to the invention, however, despite the addition of solids and the strength achieved by elongation, enhanced surface properties of the produced fibers are achieved, especially smoother fiber surfaces.

In this way, it is no longer necessary to apply economically as well as ecologically less attractive countermeasures in the form of additional operations that temporarily modify the surface, such as sizing and warping oils. Microscopically, breaks of individual capillaries as a result of spinning defects are a significant cause of a deteriorating surface quality, which becomes evident in the form of slubs in the yarn and are commonly called lint. During the downstream textile operations, such as twisting, weaving or knitting, they continuously increase in size. As a result of the mechanical strain on the yarn by friction, e.g. in the areas of snubbing rollers, eyelets, creels, etc., these loose capillaries can push on, causing the lint pieces to successively increase in size.

Hence, quantitatively, the surface quality of the continuous filament fiber can be determined by the number of lint pieces per unit of quantity of fiber, for example per 1000 meters of length (or per kilogram of yarn.) Within the scope of the invention herein, number of lint pieces per 1000 meters shall mean the number of defects in the yarn per 1000 meters of length detectable by a gauge, with a single broken monofilament already being able to cause such a defect, but two or a plurality of such individual broken capillaries in the same place not being counted twice or more times. A suitable gauge is for example an Elkometer III from Textechno.

Using the process according to the invention, upper limits for a non-twisted yarn having 4 lint pieces/1000 meters, but also 2 lint pieces/1000 meters, even 1.5 lint pieces/1000 meters can be achieved and maintained. This succeeds even with pigments incorporated during spinning in an amount of more than 15%, in particular also in the range of 18% to 25%, with these percentage data referring to percent by weight with reference to the α-cellulose. Furthermore, using the process according to the invention, twisted yarns with lint values of 1 lint piece per 1000 meters or less, in particular of 0.6 lint pieces per 1000 meters or less, can be achieved, and this even with a phosphorus-containing flame retardant with a phosphorus content with reference to cellulose of 3% to 4% being incorporated during spinning and in industrial manufacture.

For illustrating the dimensionless first parameter formed according to the invention, the following short example can be used. In the second bath, for instance, elongation by 80% shall take place at a final draw-off speed of 70 meters/minute. Then the first parameter will be 80/70=1.14.

Preferably, the first parameter will be greater than 0.75, in particular greater than 1.0. Moreover, the first parameter can more preferably be less than 1.5, preferably less than 1.33, in particular (less) than 1.25. This allows producing particularly good fiber surface properties.

Preference is given to a dimensionless second parameter, which, in contrast to the first parameter, is not formed from the quotient but from the product of the two magnitudes, in the range of 3200 upwards, preferably greater than 3600, in particular greater as 4000, although preferably in the range of less than 8000, preferably less than 7500, in particular less than 7000.

In this context, it is intended to achieve as absolute value for the final draw-off speed at least a value of 40 m/min, preferably at least 50 m/min, more preferred at least 60 m/min and in particular at least >65 m/min. Regarding elongation, stretching shall be done by at least 60%, preferably by more than 70% but preferably not more than 120%, in particular not more than 100%.

In an additional advantageous enhancement of the invention, the titer of the formed multifilament is specifically taken into consideration. In this respect, it is intended to provide for a dimensionless third parameter formed from the quotient of the second parameter and the root of the titer measured in dtex of the multifilament to be not less than 300, preferably greater than 330, more preferred greater than 360 and in particular greater than 400. In this respect, the titer information refers to the total titer of the multifilament; if it is 225, for instance, and the second parameter is around 6300, 420 results for the third parameter. But these values of the third parameter refer primarily to multifibers having a total titer of 330 dtex or less, can, however, still be used even for slightly higher titers into the range of approx. 600 dtex. In principle, however, for total titers greater than 330 dtex, in particular greater than 600 dtex or even greater than 900 dtex, a lower limit of 160, in particular of 200, is preferred for the third parameter.

As upper limit for the third parameter thus formed, the value 680 is preferred. More preferred, the third parameter should be 600 or less, more preferred less than 530 and in particular less than 500.

With respect to the added solids quantity, the total amount, stated in percent with reference to the α-cellulose, of such water-insoluble pigments shall preferably not exceed 25%. Furthermore, it is preferred for the final draw-off speed measured in meters per minute to be in the range below the curve $95-0.025x^2$, preferably below the curve $90-0.016x^2$.

With respect to applications, which require fire resistance of the items produced from the fiber, as a solid a phosphorus-containing flame retardant is preferred. The addition is preferably carried out by adding a dispersion of the particles. In particular, the addition can be made to the otherwise already spin-ready mass. The above-mentioned dispersants can also be used here.

Regarding the total titer of the multifilament fiber, a fiber strength of not less than 60 dtex is preferred. Furthermore, it is preferred for the total titer of the fiber not to be greater than 2500 dtex. Regarding the capillary titers, a range from 1.8 dtex to 2.6 dtex is considered be preferable, in particular in the range of 2.2 dtex to 2.6 dtex, where the latter is considered particularly advantageous for total yarn titers below 330 dtex. As average diameter of the single fiber, a range between 10 μm and 30 μm, preferably between 11 μm and 20 μm is considered to be advantageous.

Furthermore, it is preferable to provide for the quantity $x_{FR}$ of the phosphorus-containing flame-retardant solid at a given total titer T of the multifilament to be dosed in such a way that, in percent with reference to the α-cellulose, it is above 16.5+(290−T)/90, preferably above 17+(290−T)/90, and in particular below 19+(290−T)/90, more preferred below 18.5+(290−T)/90. The flame retardant indicated in claim 10 is particularly being considered. These quantities for $x_{FR}$ apply primarily to total titers in the range of 330 or below. For total titers in the range of 330 or greater, $x_{FR}$ should preferably be in the range between 17.5 to 19.0%.

Moreover, under this aspect of the invention, a multifilament spun and twisted from viscose is being protected, particularly one produced according to one of the above-described process aspects, in which, on the one hand, a lint number of 2 lint pieces per 1000 meters of length is not exceeded, preferably a lint number of 1 lint piece per 1000 meters not being exceeded, in particular of 0.5 lint pieces per 1,000 meters and, which, on the other hand, has a phosphorus content of 2.8% or higher with reference to the α-cellulose, preferably of 3% or higher, in particular of 3.2% or higher, as well as of 4.2% or less, preferably 4% or less, in particular 3.8% or less. Twisting takes place on suitable twisting machines, for example and preferably on Ratti Brand S500 ring twisting machines.

Particularly preferred, an upper limit of the product of lint piece number per 1000 meters of length and phosphorus content with reference to the α-cellulose expressed in percent will not be greater than 8, more preferred not greater than 6, again more preferred not greater than 4 and in particular not greater than 3. For the finished fiber, dry breaking tenacities in the conditioned state in the range above 25 cN/tex are achieved. Furthermore, after the initial shrinkage (first to second wash) the fabric produced therefrom remains at less 5% further shrinkage after another 50 washes.

The wet strength and, therefore, also the wash resistance of the produced multifilament can, for instance, be expressed by the chord modulus, wet in the twisted state cN/tex having the elongation points E1=4% and E2=3.5%, as defined in BISFA Testing Methods for Viscose, Cupro, Acetate, Triacetate, and Lyocell Filament Yarns (Cellulosic Filament Yarns), 2007 Edition, Chapter 7 (7.6.1.3). Preferably, the product of the chord modulus measured in this way expressed in cN/tex and the square root of the fiber titer expressed in dtex is in the range of not less than 280, preferably not less than 320, in particular not less than 360. Moreover, this product should preferably not exceed 560, more preferred 520 and in particular 480. These product values apply particularly to fibers having total titers of 330 dtex or less. In absolute values, the chord modulus should preferably be at least 20 cN/tex for yarn titers>200 dtex and at least 30 cN/tex for yarn titers of 120 dtex or less.

The cylinder temperature of the drying rollers, in particular in the case of this second aspect of the invention, is preferably in the range of 40° C. or higher, preferably 45° C. or higher, in particular 50° C. or higher, and preferably 95° C. or lower, preferably 80° C. or lower, in particular 70° C. or lower.

Particularly preferred as cellulose of the viscose, a cellulose having an intrinsic viscosity greater than 560 mL/g and an α-cellulose content greater than 97.5%, in particular with a monomodal molecular weight distribution, can be used, in particular a kraft coniferous pulp. For this purpose, the intrinsic viscosity should be determined according to ISO/FDIS 5351:2009 (Limiting Viscosity Number[η]).

Also placed under protection by the invention is a textile fabric that is produced subject to incorporation of a regenerated cellulose fiber, in particular a multifilament according to one of the characteristics described above.

Hereinafter, the process according to the invention will be explained using examples based on the figures of the drawing. FIG. 1 shows:

From an agitator tank, a dispersion of particles of a flame retardant solid will be conveyed by a metering pump 2, via a checkvalve 5, to a static mixer 6. Moreover, viscose is conveyed to static mixer 6 via a viscose feed pump 3. From static mixer 6, the mixture of viscose and dispersion formed therein flows to an additional static mixer 7, where mixing continues.

The delivery stream leaving static mixer 7 runs through a mass flow meter 8 to a spinning machine, in which the regenerated cellulose fiber is spun. Likewise, the feed stream of the dispersion conveyed to static mixer 6 runs through another mass flow meter 9. A control unit 10, responding to the measuring signals of mass flow meters 8 and 9, generates a control signal for the drive of metering pump 2, by which the mass ratio of the two delivery streams is adjusted to a desired value.

Moreover, the pressure of the feed stream conveyed to the spinning machine is picked up by a pressure sensor 4 and, as a function of its measuring signal, the delivery rate of viscose feed pump 3 is controlled.

Figure 2:
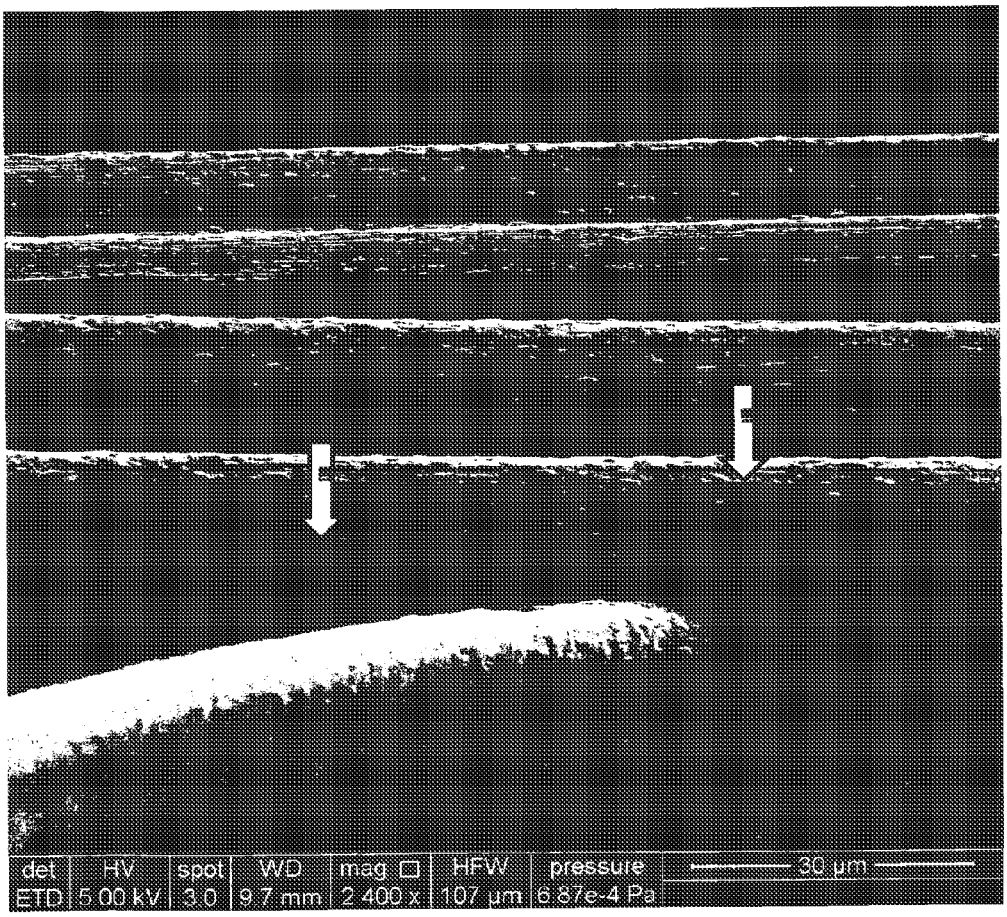
FIG. 2 is a SEM of a multifilament produced according to the first aspect of the embodiments described herein.

FIG. 2 is a SEM of a multifilament produced in any case according to the first aspect of the invention herein. Indicated by the arrows, the orientation of the major axis of the particles in the parallel preferred direction of the fiber can be recognized.

Moreover, another exemplary embodiment of the invention is indicated hereinafter:

In the industrial process, a multifilament having a titer 200f76 is produced using continuous spinning technology. To the spin mass, the phosphorus-containing flame proofing pigment Viscofil Exolit 5060VP2988 was additionally added. At this point and also in general for this application, industrial process shall be understood to be a process, in which the machine used achieves an hourly production of at least 6 kg or preferably at least 8 kg, in particular at least 10 kg per hour.

The temperature of the coagulation spin bath is in the range of 58° C. to 63° C., the drawing bath in the range of 90° C. to 94° C. The addition of the flame proofing agent is done in such a way that a solids content in the yarn (with reference to α-cellulose) of 19.8% results.

In the drawing bath, elongation by 85% takes place, the final draw-off takes place at a speed of 80 m/min. This results in a first parameter of 1.06.

The dimensionless second parameter is 6800, and the dimensionless third parameter is 480.

The phosphorus content of the fiber with reference to the α-cellulose is in the range of 3.5%. However, the fiber in the conditioned state retains a dry breaking tenacity in untwisted form in the range of 265 to 285 cN/100 dtex. In spite of the good flame proofing effect and the high strength, this multifilament yarn in twisted form (S500) now contains only 0.4 to 0.6 lint pieces per 1000 meters. It is, therefore, superbly suitable for further processing, in particular as warp material.

The invention is not limited to the characteristics individually pointed out in the exemplary embodiments. Rather, the characteristics of the following claims and the preceding specification may be essential individually or in combination for implementation of the invention in its various embodiments.

The invention claimed is:

1. A process for production of regenerated cellulose fiber, comprising: producing a multifilament fiber, wherein after the addition of a pigment-comprising solid at a certain quantitative ratio viscose is mixed in and the mixture thereby resulting is wet-spun according to specific parameters and after precipitation in the spin bath is elongated in a secondary bath and finally drawn off from the secondary bath, wherein an amount of pigments incorporated during spinning is more than 15% with this percentage data referring to percent by weight with reference to α-cellulose, wherein a dimensionless first parameter formed from a quotient of the elongation expressed in percent and a final draw-off speed expressed in meters per minute is less than 1.5, and wherein a dimensionless second parameter formed from: the product of the elongation expressed in percent and the final draw-off speed expressed in meters per minute, is greater than 3600 and less than 7500, and wherein the final draw-off speed is at least 65 m/min and elongation by stretching is not more than 100%.

2. The process according to claim 1, wherein the dimensionless first parameter is greater than 0.75.

3. The process according to claim 1, wherein a dimensionless third parameter formed from the quotient of the second parameter and the root of the titer of the multifilament measured in dtex is greater than 300.

4. The process according to claim 3, wherein the dimensionless third parameter formed from the quotient of the second parameter and the root of the titer of the multifilament measured in dtex is less than 680.

5. The process according to claim 1, wherein, with reference to the α-cellulose, the total amount x of the added amount of solids, expressed in percent, preferably does not exceed 25% and the final draw-off speed expressed in meters per minute is below the curve $95-0.025x^2$.

6. The process according to claim 1, wherein the produced fiber is a multifilament fiber having a total titer greater than 60 dtex and less than 2500 dtex, the capillary titer being in the range of 1.8 to 2.6 dtex.

7. The process according to claim 1, wherein the quantity $x_{FR}$ of the phosphorus-containing flame retardant solid, as a function of the specified total titer T of the multifilament, is added in such a way that, in percent with reference to the α-cellulose, it is above 16.5+(290−T)/90 and below 19+(290−T)/90 if T is 330 dtex or less, and it is in the range of 17.5 to 19.0% if T is greater than 330 dtex.

8. The process according to claim 1, wherein the number of lint pieces per 1000 m of untwisted multifilament is less than 4.

9. The process according to claim 1, wherein the cellulose used is a cellulose having an intrinsic viscosity greater than 560 mL/g and an α-cellulose content greater than 97.5%, its molecular weight distribution being monomodal, including a kraft coniferous pulp.

10. The process according to claim 1, further comprising: producing a textile fabric with incorporation of the regenerated cellulose fiber, including the multifilament fiber.

11. The process according to claim 1, wherein the solid exerts a flame-retardant effect and is phosphoric, and the addition takes place in the form of an added dispersion of the particles.

12. The process of the claim 1, further comprising:

spinning and twisting a multifilament from the viscose, having a lint piece number of 2 lint pieces per 1000 meters of length or less and a phosphorus content with reference to the α-cellulose of 2.8% or higher as well as of 4.2% or less.

13. The process according to claim 1, wherein the product of the chord modulus [3.5%-4% wet] in the twisted state and the square root of the titer expressed in dtex is between 280 and 560.

* * * * *